US011192117B2

(12) United States Patent
Giersemehl et al.

(10) Patent No.: US 11,192,117 B2
(45) Date of Patent: Dec. 7, 2021

(54) MILL

(71) Applicant: NEUMAN & ESSER PROCESS TECHNOLOGY GMBH, Übach-Palenberg (DE)

(72) Inventors: Marc Giersemehl, Krefeld (DE); Thomas Mingers, Übach-Palenberg (DE); Joachim Galk, Gangelt-Birgden (DE)

(73) Assignee: NEUMAN & ESSER PROCESS TECHNOLOGY GMBH, Übach-Palenberg (DE)

( * ) Notice: Subject to any disclaimer, the term of this patent is extended or adjusted under 35 U.S.C. 154(b) by 173 days.

(21) Appl. No.: 16/349,342

(22) PCT Filed: Nov. 2, 2017

(86) PCT No.: PCT/EP2017/078060
§ 371 (c)(1),
(2) Date: May 13, 2019

(87) PCT Pub. No.: WO2018/091276
PCT Pub. Date: May 24, 2018

(65) Prior Publication Data

US 2019/0344283 A1 Nov. 14, 2019

(30) Foreign Application Priority Data

Nov. 15, 2016 (DE) ..... 10 2016 121 926.6

(51) Int. Cl.
*B02C 15/02* (2006.01)
*B02C 15/00* (2006.01)
*B02C 15/04* (2006.01)

(52) U.S. Cl.
CPC ..... *B02C 15/001* (2013.01); *B02C 15/007* (2013.01); *B02C 15/02* (2013.01); *B02C 15/045* (2013.01); *B02C 2015/002* (2013.01)

(58) Field of Classification Search
CPC ... B02C 15/02; B02C 2015/002; B02C 15/04; B02C 15/06; B02C 15/08; B02C 15/007;
(Continued)

(56) References Cited

U.S. PATENT DOCUMENTS 1,573,191 A * 2/1926 Raymond ..... B02C 15/02 241/58
1,655,499 A * 1/1928 Gibson ..... B02C 15/02 241/124

(Continued)

FOREIGN PATENT DOCUMENTS

CN 106000549 A 10/2016
DE 102009051226 A1 5/2011
DE 102011014592 A1 9/2012

OTHER PUBLICATIONS

Chinese Office Action dated Apr. 19, 2021 for family member Application No. 201780070072.5.

*Primary Examiner* — Gregory D Swiatocha
*Assistant Examiner* — Bobby Yeonjin Kim
(74) *Attorney, Agent, or Firm* — Hudak, Shunk & Farine Co. LPA

(57) ABSTRACT

A mill, in particular a pendulum mill or roller mill, having a classifier, wherein the mill has a mill housing with an interior in which there is situated a milling space B1 in which a milling device having at least one milling tool is arranged. The classifier is arranged above the milling device in a classifying space B3. At least one drop device is provided which connects the classifying space B3 to the milling space B1. Arranged below the classifier is at least
(Continued)

one distribution plate which has at least one drop opening on which the at least one drop device is arranged.

17 Claims, 6 Drawing Sheets

(58) Field of Classification Search
CPC ..... B02C 15/10; B02C 23/32; B02C 23/12; B02C 17/1845; B01D 46/0056; B01D 46/26
See application file for complete search history.

(56) References Cited

U.S. PATENT DOCUMENTS 1,663,881 A * 3/1928 Gibson ..... B02C 15/02 241/53
1,834,094 A * 12/1931 Fraser ..... B02C 15/02 241/48
1,967,236 A * 7/1934 Fraser ..... B02C 15/02 241/56
2,092,307 A * 9/1937 Gaffney ..... B02C 13/14 241/53
3,071,330 A * 1/1963 Gunther ..... B02C 13/16 241/53
3,951,347 A * 4/1976 Tiggesbaumker .... B02C 15/007 241/52
4,597,537 A * 7/1986 Misaka ..... B02C 23/32 241/79.1
4,673,134 A * 6/1987 Barthelmess ..... B02C 17/16 241/57
4,830,290 A 5/1989 Williams
4,889,289 A * 12/1989 Lohnherr ..... B02C 21/00 241/18
4,919,341 A * 4/1990 Lohnherr ..... B02C 23/32 241/18
5,279,466 A * 1/1994 Williams ..... B02C 23/32 209/139.1
5,330,110 A * 7/1994 Williams ..... B02C 15/02 241/119
5,667,149 A * 9/1997 Eisinger ..... B02C 15/001 241/119
5,971,302 A * 10/1999 Doumet ..... B02C 15/00 241/17
8,925,844 B2 1/2015 Keyssner
2009/0121060 A1 * 5/2009 Chen ..... B02C 15/02 241/110
2013/0313348 A1 11/2013 Keyssner

* cited by examiner

MILL

FIELD OF THE INVENTION

The present invention relates to a mill, in particular a pendulum mill or roller mill, comprising a longitudinal axis X and a classifier, wherein the mill has a mill housing with an interior in which there is situated a milling space B1 in which a milling device having at least one milling tool is arranged, wherein the classifier is arranged above the milling device in a classifying space B3 and has a classifying zone, and wherein at least one drop device is provided which connects the classifying space B3 to the milling space B1.

BACKGROUND OF THE INVENTION

Mills are used for the crushing of solids such as coal, minerals or pigments. Depending on their design, one distinguishes among pendulum mills, impact mills, bowl mills, roller mills or jet mills, though this listing is only an example.

Pendulum mills are characterized by their milling tools designed as a pendulum. These pendulums are suspended from a crosshead, which sits on a shaft, and are forced by the rotational movement of the shaft and the crosshead radially outward and against a grinding track situated there. Grinding stock gets in between the grinding pendulum and grinding track during the grinding process and is crushed there.

The crushed grinding stock is then classified. During the classification, the sufficiently small particles (fine material) are removed and particles with tool large a particle size (coarse material) are once more fed to the mill in order to be further crushed. In this way, a material cycle is created, which particles run through until such time as the desired particle size is achieved.

Such a pendulum mill is known for example from DE 10 2009 051 226 A1 In this known pendulum mill, a classifier is arranged directly above the grinding mechanism. The return of the coarse material occurs via a worm, by means of which the coarse material is at first transported from the area between classifier and pendulum mill in order to be mixed with fresh feedstock on the outside, i.e., the solid being ground. This mixture is then fed to the pendulum mill above the grinding area. This return process is very costly and energy intensive.

A different route is taken by U.S. Pat. No. 5,330,110, which discloses a pendulum mill with integrated classifier and a particle circulation device. During the particle circulation, all of the particles are accelerated radially outward by a rotor and strike against the outer wall of the pendulum mill. Coarse and fine particles are separated here. Added to this are the coarse particles building up on the classifier. All of the coarse particles are returned to an area underneath the pendulum through drop pipes outside the mill housing. Thanks to the flow created inside the mill housing, the coarse particles are once more transported from underneath into the grinding area and are further crushed.

The pendulum mill of U.S. Pat. No. 5,279,466 also has a similar construction. But here the coarse material is introduced into the grinding area from above. In both cases, the design space of the pendulum mill is increased, which is a drawback.

Alternatively, the return of the coarse material may also occur inside the mill housing per U.S. Pat. No. 4,830,290. But in this kind of return, opposing streams are created: one for the particles rising up and moving in the direction of the classifier, and one for the descending particles of coarse material. These two streams hinder each other, among other things resulting in the particles not yet sorted being carried along by the coarse material. In this way, particles which are already small enough end up once more in the grinding area and may possibly be further crushed. This is undesirable. On the whole, the oppositely directed streams result in an increased power consumption and a lower throughput of the mill.

US 2009/0121060 A1 tries to solve this problem in that a tubular insert is arranged in the mill housing. An annular space is formed between the insert and the outer wall of the mill housing, being provided for the particles of coarse material dropping down. On the other hand, the particles rising up from the grinding area are located in the interior of the insert. In this way, the two streams of particles should be separated, thereby avoiding the described drawbacks.

However, the solution of US 2009/0121060 A1 is disadvantageous for several reasons. On the one hand, the annular space is very narrow and it is debatable whether the coarse material will indeed find its way into the annular space. Furthermore, the possibility exists of the annular space getting clogged. Finally, a direct return to the grinding pendulum is not assured. The coarse material arrives through the annular space in an area to the side and above the grinding rollers. Due to the rising flow, the possibility exists of particles not being further crushed at all, but instead carried along once more directly by the flow and taken to the classifier. This reduces the throughput of the mill, because the particles have to run through the entire cycle once more.

From DE 10 2011 014 592 A1 there is known a roller mill with integrated classifier that comprises a grinding bowl, which rotates about a longitudinal axis of the mill. The grinding bowl is provided with a grinding track, on which a grinding bed is formed by the feedstock. Stationary grinding rolls roll along the grinding bed.

The coarse material rejected by the classifier drops into a grit cone, having an opening in its bottom, making possible a central feed of the coarse grains to a distribution cone. Because of turbulence in the milling space, only a portion of the returned coarse material reaches the grinding rolls.

SUMMARY OF THE INVENTION

Therefore, the problem which the invention proposes to solve is to provide a mill making possible a higher throughput than the present mills.

This problem is solved by a mill in particular a pendulum mill or roller mill, having a longitudinal axis X and a classifier.

The mill has a mill housing with an interior in which there is situated a milling space B1 in which a milling device having at least one milling tool is arranged. The classifier is arranged above the milling device in a classifying space B3 and has a classifying zone. At least one drop device is provided which connects the classifying zone to the milling space. The mill is characterized in that at least one distribution plate is arranged below the classifier, having at least one drop opening on which the at least one drop device is arranged.

The mill is preferably a pendulum mill with a rotationally situated milling device, having at least one milling tool. The milling tool preferably comprises a grinding pendulum with a rotationally mounted grinding roller or grinding roll, which runs around a stationary grinding ring, for example. The mill according to a further embodiment may be a roller mill with a stationary situated milling device, having at least one milling tool. The milling tool preferably comprises a stationary situated grinding pendulum with a rotationally mounted grinding roller or grinding roll, which interacts for example with a rotating grinding bowl.

The grinding track is the surface on which the grinding roller or grinding roll rolls along on the grinding ring or the grinding bowl.

The longitudinal axis X of the mill is preferably a vertical axis and is preferably identical to the axis of rotation of the mill.

The coarse material rejected by the classifier drops onto the distribution plate arranged beneath the classifier and from there goes through the at least one drop opening into the respective drop device. This has the benefit that the coarse material is channeled at once inside the mill housing, so that it mostly avoids contact with the grinding stock/air stream flowing up from the milling space. Thanks to this kind of separation of the two streams, the throughput of the mill has been boosted by as much as 20%. Hence, with the mill according to the invention, more grinding stock can be crushed per unit of time and the mill can accordingly be operated more economically.

The interior of the mill housing of the mill is divided into three regions in the direction of the force of gravity, i.e., from top to bottom. In an upper region is located the classifying space, which reaches preferably from a mill cover to a lower edge of the classifier wheel. In a lower region is located the milling space, in which the grinding rollers of the milling tools are arranged. Between these two spaces is located a transport space, in which the ground material is transported upward to the classifier and the coarse material rejected by the classifier drops downward.

The distribution plate is situated in the transport space, preferably in the upper region of the transport space.

Preferably, the diameter of the distribution plate is equal to or greater than the diameter of the classifier wheel, in particular, equal to or greater than the outer diameter of the classifier. This ensures that the entire coarse material dropping out from the classifier zone of the classifier is caught by the distribution plate.

Preferably, an encircling boundary wall is arranged between the classifier and the distribution plate. The boundary wall prevents the coarse material dropping down from the classifier from missing the distribution plate and thus not getting into the drop opening.

Preferably the height of the encircling boundary wall is equal to or less than the spacing between the classifier and the distribution plate. Preferably, the boundary wall has an upper circular edge and a lower circular edge. The diameter of the upper circular edge is preferably greater than the inner diameter of the guide vane assembly, especially greater than the outer diameter of the guide vane assembly. The diameter of the lower circular edge is preferably less than the diameter of the distribution plate.

Depending on the dimensions of the diameter of the classifier and the distribution plate, the encircling boundary wall may be a cylinder or a cone. A conical boundary wall with a diameter of the lower edge smaller than the diameter of the upper edge is used in particular when the diameter Dv of the distribution plate is less than the diameter D1 or D2.

The encircling boundary wall is preferably fixed to the classifier housing.

In order to distribute the coarse material as evenly as possible, the distribution plate has a plurality of drop openings and thus also a plurality of drop devices.

Preferably, a plurality of drop openings are provided in the distribution plate, being arranged on a circle K1 about the longitudinal axis X of the mill, while the diameter of the circle K1 lies preferably in the range between the diameter of the classifier wheel and the outer diameter of the classifier.

In order to prevent a collision of the coarse material dropping down and the upwardly flowing grinding stock/air stream, in addition a cylindrical wall may be arranged between the classifier and the distribution plate. The diameter of the cylindrical wall preferably corresponds to the diameter of the distribution plate.

Preferably, the at least one drop device is arranged in the interior of the mill housing, especially inside the transport space. The benefit is that in this way a compact configuration of the mill can be realized.

A further benefit of the drop device is that with the help of the drop device the coarse material arrives not only in the milling space, but also can be precisely taken to the spot where the grinding process is occurring.

Preferably, the at least one drop device extends as far as the respective grinding roller or grinding roll.

In this way, the two streams (coarse material from the classifier to the milling space and ground material from the milling space to the classifier) are separated from each other even more effectively. Opposing streams which hinder each other and result in turbulence are largely avoided not only in the transport space, but also in the milling space.

In order to bring up the coarse material as close as possible to the area in which it is supposed to be ground, in one advantageous modification it is provided that the at least one drop device is associated with at least one respective milling tool, and the drop device extends in the milling space as far as the respective milling tool.

Preferably, the at least one drop device extends as far as the respective grinding roller or grinding roll.

In advantageous modifications of the mill it is provided that at least one drop device is arranged respectively between two milling devices. Preferably, a drop device is arranged each time between every two milling tools. Especially preferably, the mill has the same number of milling tools, drop openings and drop devices.

Especially preferably, at least one outlet of the drop device is directed at the mill bottom and/or a grinding track and/or a grinding roller.

The exit direction of the outlet of the drop device influences the grinding process. By the exit direction is meant the direction in which the coarse material flows from the drop device after exiting from the drop device. The exit direction in particular is situated perpendicular to an outlet surface of the outlet. The outlet surface in particular is a surface that closes the outlet opening in the drop device. Preferably, the outlet surface is a plane parallel to the longitudinal axis of the mill.

In advantageous modifications of the mill it is provided that one horizontal component of the outlet direction of at least one drop device makes an outlet angle $\gamma$ with a radial direction of a circle K2 on which the drop devices are arranged, while $70° < \gamma < 110°$.

For a given outlet, one will consider the radial direction which runs through the vertical axis of the corresponding drop device. The intersection of the radial direction in question and the outlet direction lies on the vertical axis of the corresponding drop device. The radial direction and the outlet direction make the outlet angle $\gamma$. The circle K2 is a circular track on which the vertical axes of the drop devices lie or on which the vertical axes of the drop devices advance when the device is used as intended, as is preferably the case when used in a pendulum mill. In this way, the coarse material emerges substantially in or against the turning direction of the drop devices. An exit against the turning direction means that less turbulence is caused in the milling space.

Likewise, advantageous is an arrangement of the horizontal component of the outlet direction of at least one drop device to the radial direction at an outlet angle γ, where $-30° < \gamma < +30°$. In this way, the outlet of coarse material occurs substantially along the radius of the circle K2. In this case, the outlet opening may be directed inward from the circle K2 in the direction of its center or outward. If the outlet opening is directed outward, the coarse material will emerge in the direction of the grinding track, so that the coarse material will arrive directly in the region where it is supposed to be ground.

In advantageous modifications of the mill it is provided that at least one drop device is tapered at the lower end or has a smaller cross section than the rest of the drop device. This design of the drop device will be used in particular when only a slight amount of coarse material needs to be transported from the classifying zone into the grinding region. If the opening for the coarse material is too large in relation to the amount of coarse material, an inadequate flow may result.

Preferably, the at least one drop device has a curved section with an outlet at a lower end.

In this way, the outlet of the drop device can be oriented such that the coarse material is transported from a drop device in a particular direction, in a particular region of the mill, or onto a particular component of the mill.

Preferably, the drop device comprises a drop space, a drop pipe and/or a drop tube which is separate in the interior of the mill housing. The drop space may be separated off inside the mill housing by appropriate fixtures, for example. The cross section of the drop devices may be chosen arbitrarily; round or polygonal cross sections are preferred for manufacturing reasons.

According to one special embodiment, the milling device and the at least one drop device are able to rotate about the longitudinal axis X. The joint rotation of milling device and drop device or drop devices is used preferably in a pendulum mill.

Preferably, the distribution plate is arranged on a rotating milling device.

The pendulum mill has a drive shaft, on which the milling device is fastened. The milling device preferably has a crosshead, on which the grinding pendulums are hung. Preferably, the at least one distribution plate is secured on a drive shaft of the mill or on a crosshead secured to the drive shaft.

Thanks to the arrangement of the drop openings and thus also the drop devices on a circle, a uniform load distribution is made possible for the crosshead and the drive shaft. Other arrangements may result in nonuniform strain especially for the drive shaft, which shortens its service life.

The material being ground (grinding stock) has a tendency to become deposited on a mill bottom of the mill housing. In one advantageous modification of the mill, at least one scoop is arranged in the mill housing, and each scoop is associated with a drop device. The scoops are preferably arranged on the mill bottom and likewise rotate about the axis of rotation X and transport the grinding stock from the mill bottom in the direction of the respective grinding roller or the grinding track.

Preferably, at least one outlet of the drop device is directed at a scoop.

BRIEF DESCRIPTION OF THE DRAWINGS

The invention shall now be explained and represented in the following as an example with the aid of the figures. There are shown.

DETAILED DESCRIPTION OF THE INVENTION

Figure 1:
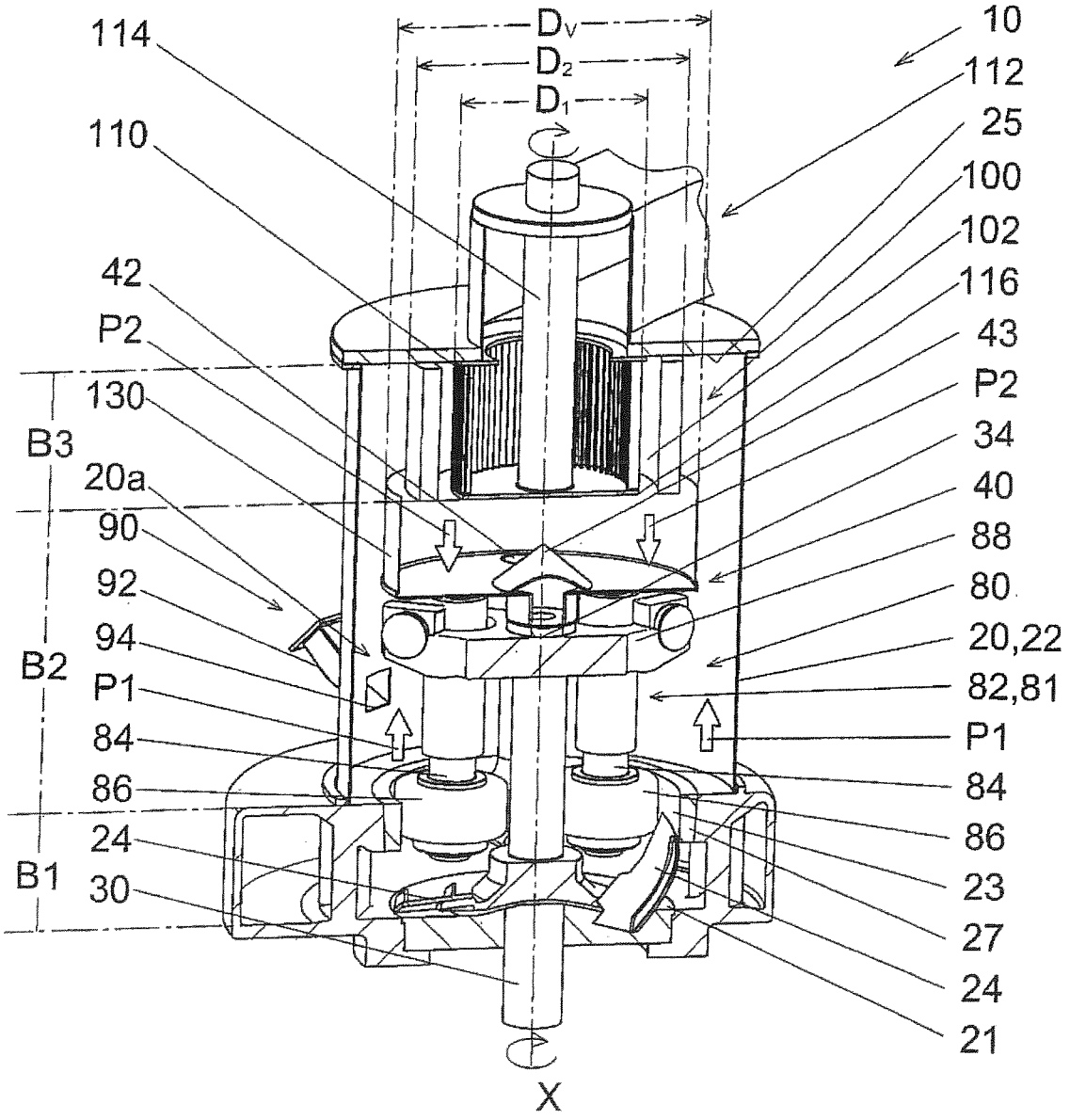
FIG. 1 a pendulum mill in a perspective, sectional representation.

FIG. 1 shows an embodiment of a mill 10, designed as a pendulum mill. The pendulum mill 10 has a longitudinal axis X, which also forms the axis of rotation at the same time. The pendulum mill 10 comprises a mill housing 20 with an interior 20*a*, which is bounded by a peripheral wall 22, a mill cover 25 and a mill bottom 21.

The interior 20*a* of the mill housing 20 is divided into three spaces B1, B2 and B3, designated as the milling space B1, the transport space B2 and the classifying space B3.

In the classifying space B3 is arranged the classifier 100, having a classifier wheel 110 with diameter D1. The classifier wheel 110 is driven by means of a classifier shaft 114. The classifier 100 furthermore comprises a guide vane assembly 111 surrounding the classifier wheel 110, having an outer diameter D2. Between the classifier wheel 110 and the guide vane assembly 111 is situated the classifying zone 102 of the classifier 100.

Beneath the classifier 100 is located a milling device 80 with a crosshead 88 and three milling tools 81 in the form of grinding pendulums 82, two of which being represented. Each grinding pendulum 82 has a pendulum shaft 84 with a grinding roller 86. The grinding rollers 86 are located in the milling space B3.

The grinding pendulums are swivel-mounted on the crosshead 88. When used as intended, the grinding pendulums 82 are pressed against the grinding track 23 of the grinding ring 27 of the mill housing 20. The grinding stock is ground between the grinding spaces 86 and the grinding track 23.

Beneath the mill housing 20 is arranged a drive mechanism (not shown), which drives a drive shaft 30. The drive shaft 30 extends from the drive mechanism to the mill housing 20. The crosshead 88 of the milling device 80 is arranged at the upper end 34 of the drive shaft 30.

The milling space B1 extends from the mill bottom 21 upward to an upper edge 26 of the grinding track 23. The classifying space B3 extends from a mill cover 25 to a lower edge 116 of the classifier wheel 110. Between the spaces B1 and B3 is situated the transport space B2, in which the distribution plate 40, the crosshead 88 and the pendulum shaft 84 are arranged. The grinding pendulums 82 extend from the crosshead 88 to the milling space B1.

In the transport space B2, a distribution plate 40 with a diameter Dv which is larger than the outer diameter D2 of the classifier 100 is arranged above the crosshead on the drive shaft 30. The distribution plate 40 when used as intended is driven in rotation by the drive shaft 30. In this way, the distribution plate 40 likewise turns about the axis of rotation X. The distribution plate 40 comprises a round disc, in which drop openings 42 are arranged. At the center of the distribution plate 40 there is arranged a distributing cone 43. Only one drop opening 42 is represented of the plurality of drop openings 42, where a downwardly extending drop device 60 in the form of a drop pipe is secured.

In operation, the grinding stock and air stream rises upward in the transport space B2, as indicated by the arrows P1. At the same time, the coarse material is rejected by the classifier 00 in the classifying zone 102 and drops down onto the distribution plate 40, as indicated by the arrows P2. Between the classifier 100 and the distribution plate 40 is situated an encircling boundary wall 130, which prevents contact between the streams P1 and P2 in the upper region of the transport space B2. The boundary wall 130, which is fixed in location, is designed as a cylinder whose height is less than or equal to the spacing between the classifier 100 and the distribution plate 40. The diameter of the upper edge of the cylinder is greater than the diameter D2 of the classifier 100. The diameter of the lower cylinder edge is less than or equal to the diameter Dv of the distribution plates 40.

On the mill housing 20 is arranged a grinding stock feed 90, comprising a chute 92, which extends from a region outside the mill housing 20 to the interior of the mill housing 20. A grinding stock outlet 94 is arranged in the transport space B2 above the milling space B1. The material to be ground is introduced through the grinding stock feed 90 into the mill housing.

Above the classifier 100 there is arranged a suction device 112. The suction device 112 stands in communication with the interior of the classifier wheel 110 and generates a flow, which serves to lift up the material ground between the grinding rollers 86 and the grinding track 23. The material flows from the milling space B1 outside the boundary wall 130 through the transport space B2 and into the classifying space B3. In the classifying space B3, the material at first finds itself outside the guide vane assembly 11 of the classifier 100. Thanks to the flow generated by the suction device 112, the material moves through the guide vane assembly 111 into the classifying zone 102. The classifier wheel 110 separates the material into coarse material and fine material. The fine material gets into the interior of the classifier wheel 110 and is transported by the suction device 112 out from the mill housing 20. The coarse material is rejected by the classifier wheel 110 and drops onto the distribution plate 40—as already described.

Figure 2:
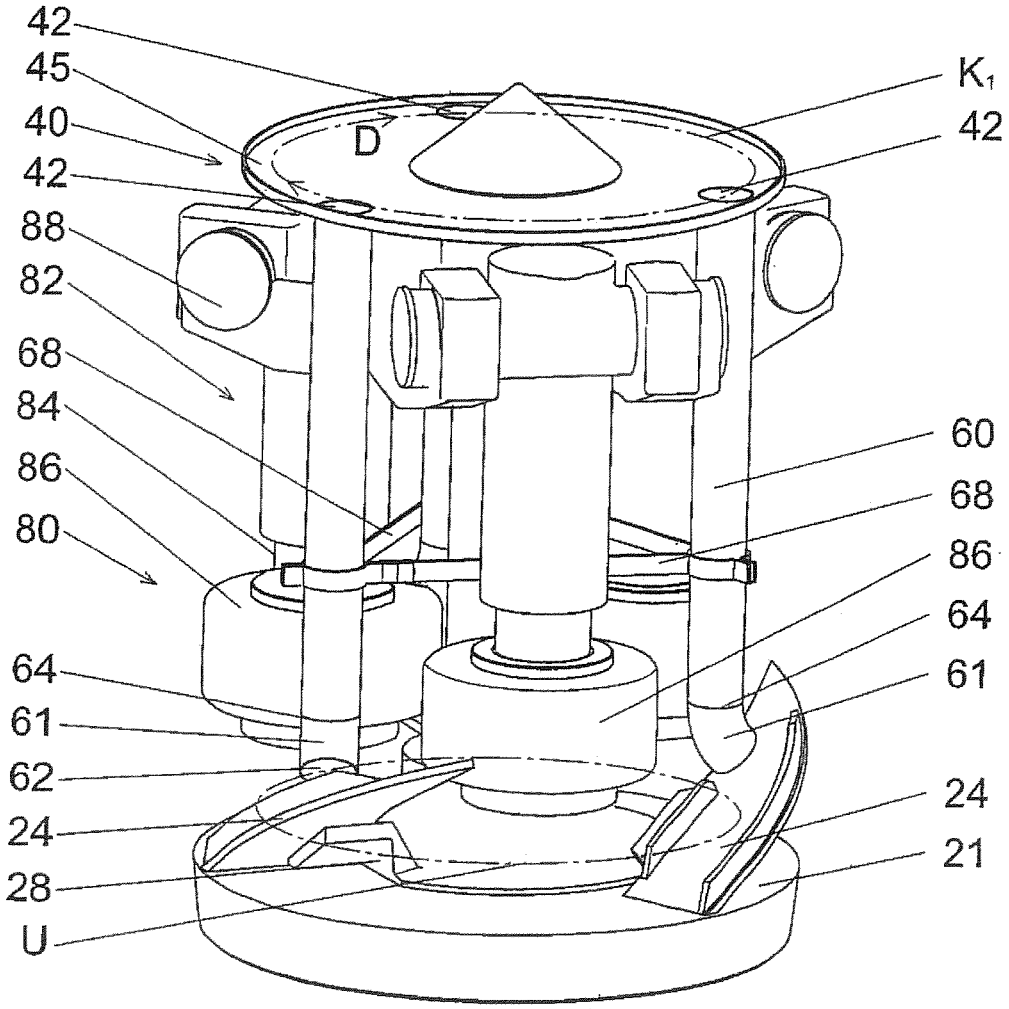
FIG. 2 the milling device of the pendulum mill with distribution plate of FIG. 1 in a perspective representation, FIG. 3 a distribution plate of the pendulum mill in a top view, FIG. 4 the distribution plate and the drop pipes of a pendulum mill in a perspective representation, FIG. 5 the distribution plate and the drop pipes of a pendulum mill according to a further embodiment in a perspective representation, and FIG. 6 a schematic representation of parts of a pendulum mill according to a further embodiment.

FIG. 2 shows basically the arrangement of the milling device 80 in combination with the distribution plate 40 with the distributing cone 42 arranged on its top 45 and the drop devices 60 from FIG. 1. Other parts of the pendulum mill are left out for drafting reasons.

The distribution plate 40 has three drop openings 42, which are arranged on a circle K1. The midpoint of the circle K1 lies in the axis of rotation X. The drop openings 42 are arranged on the circle K1 at regular angular intervals about the axis X. D designates the turning direction of the distribution plate 40. Drop devices 60 designed as drop pipes are fastened to the drop openings 42.

In the representation shown here, the pendulum mill 10 comprises three drop pipes 60. A respective grinding pendulum 82 is arranged along an orbit U (circle K2) of the drop pipes 60 between every two drop pipes 60. Likewise, a respective drop pipe 60 is arranged along the orbit U between every two grinding pendulums 82. The drop pipes 60 are joined together by struts 68. The struts 68 prevent vibrations of the drop pipes 60 during operation. Beneath the drop pipes 60 are drawn scoops 24, which are connected by a support structure 28 to the drive shaft 30 and are driven in rotation by the latter. Grinding stock which has settled on the mill bottom 21 is moved by the scoops 24 in the direction of the grinding track 23, in order to be ground up between the grinding rollers 86 and the grinding track 23.

Each scoop 24 is thus associated with a drop pipe 60. In the present case, the outlets 62 of the drop pipes 60 are oriented such that the material from the drop pipe 60 after exiting from the outlet 62 lands directly on the scoop 24 and in this way is taken at once to the grinding roller 86.

Figure 3:
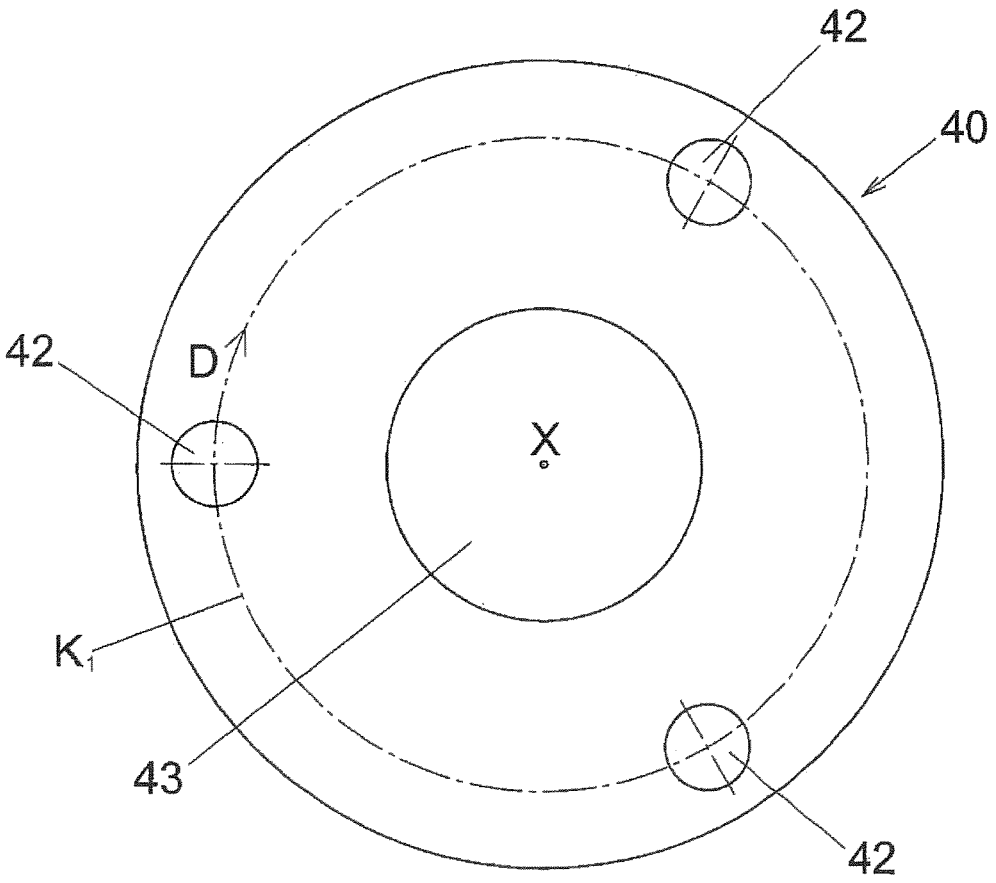

FIG. 3 shows an enlarged top view of the distribution plate 40. One can see that the drop openings 42 are arranged on the circle K1. At the center of the distribution plate 40 is found the distributing cone 43.

Figure 4:
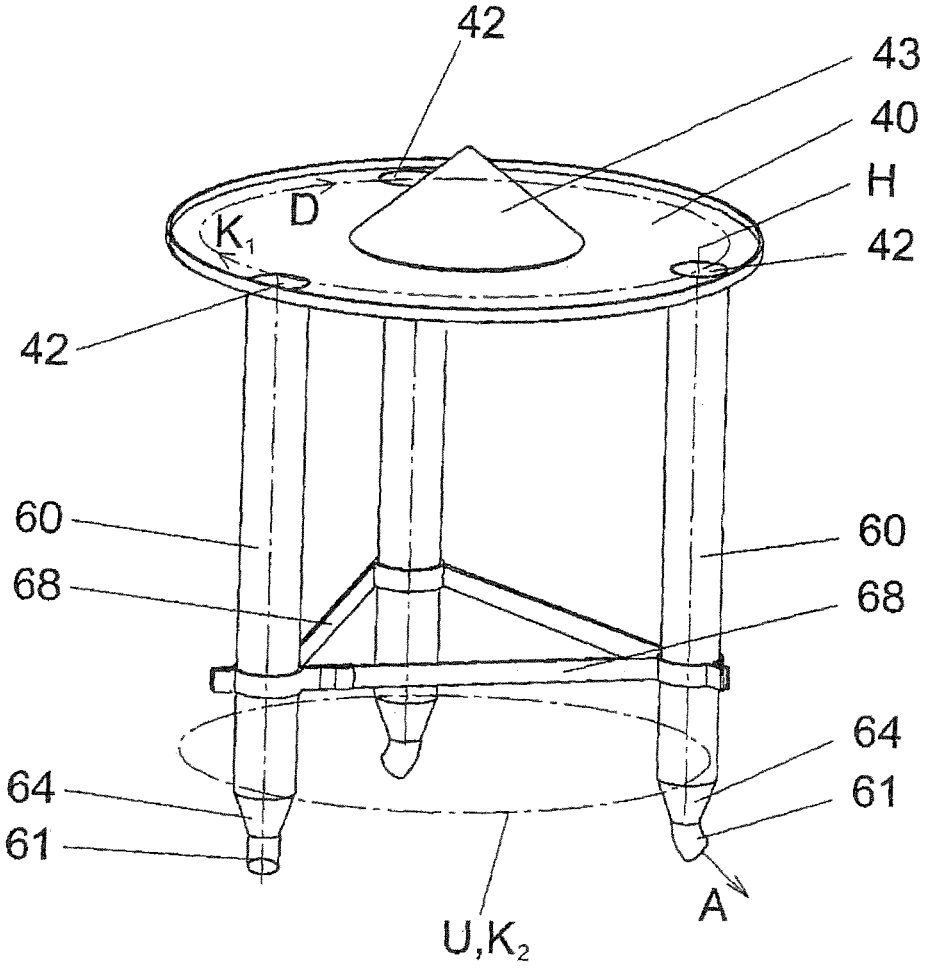

FIG. 4 shows an embodiment in which each drop pipe 60 tapers at a lower end 64 and then passes into a curved section 61.

Figure 5:
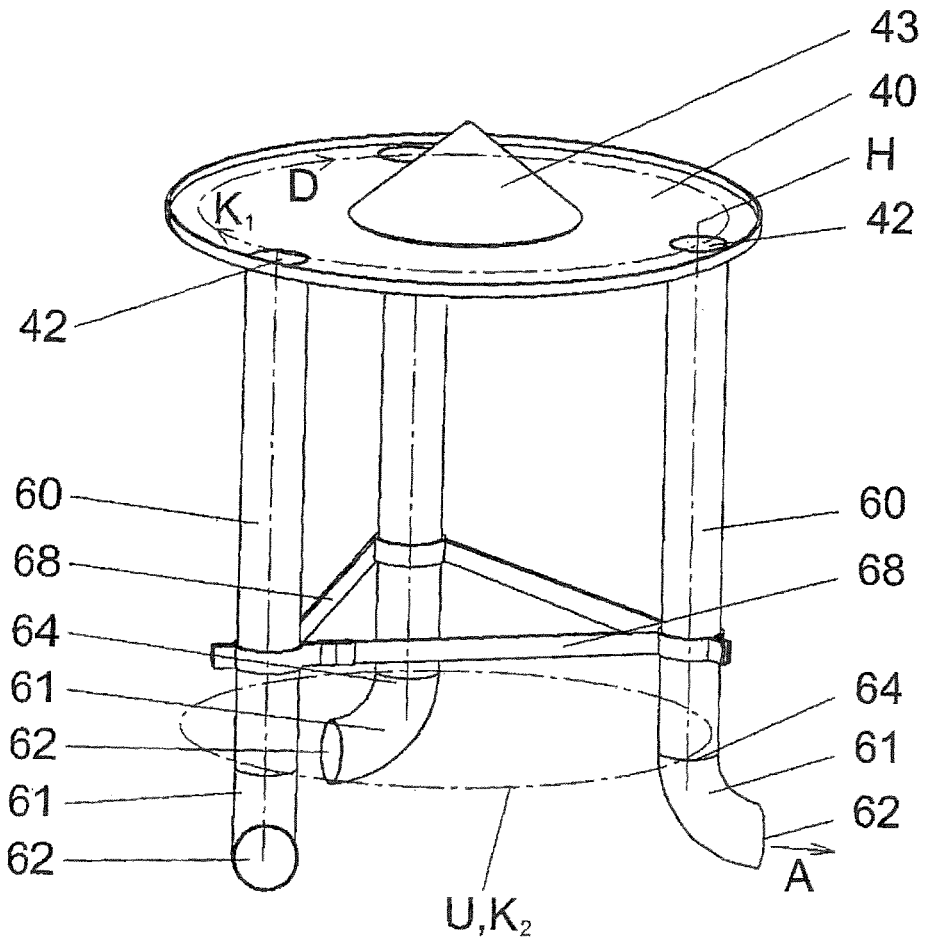

A further embodiment is shown in FIG. 5. The drop pipes 60 do not taper, but each have a curved section 61 at their lower end 64.

Figure 6:
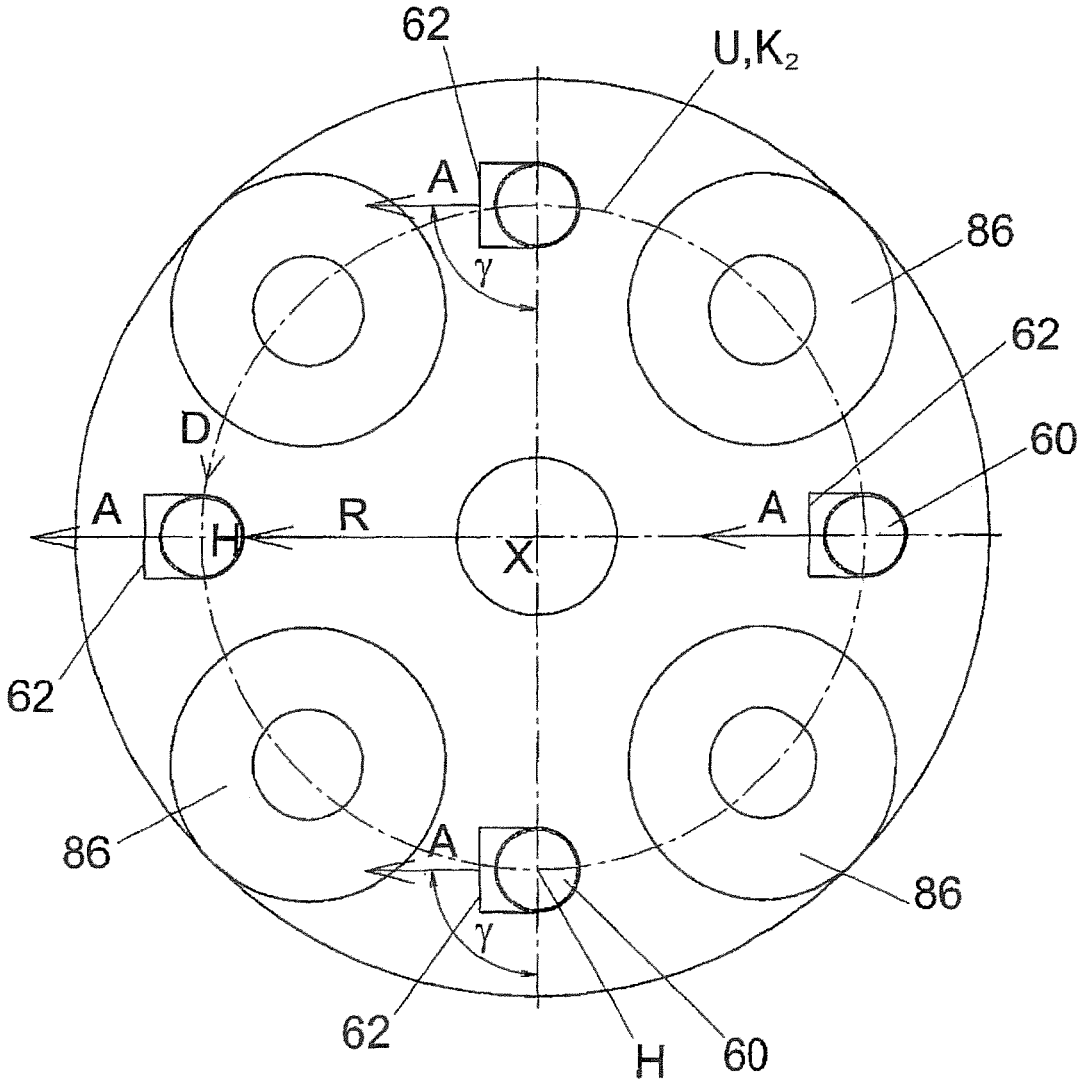

FIG. 6 shows a schematic bottom view of the milling device 80 with different arrangements of the drop pipes 60. Each drop pipe 60 has a vertical axis H. The drop openings 42 of the drop pipes 60 are arranged on a circle K1 about the axis of rotation X. The circle K1 has radial directions R. Of the radial directions R, the ones which run through the vertical axes H of the drop pipes 60 are shown. The drop pipes 60 each have an outlet direction A. In FIG. 6, all outlet directions A are horizontal. The outlet directions A are each arranged at an angle $\gamma$ to the radial direction R of the respective drop pipe. For two of the drop pipes 60 shown, the angle $\gamma$ is between −30° and +30°, for the other two drop pipes 60 the angle $\gamma$ is between 70° and 110°.

LIST OF REFERENCE SYMBOLS

10 Mill, pendulum mill
20 Mill housing
**20*a*** Interior
21 Mill bottom
22 Peripheral wall
23 Grinding track
24 Scoop
25 Mill cover
26 Upper edge
27 Grinding ring
28 Support structure
30 Drive shaft
34 Upper end
40 Distribution plate
42 Drop opening
43 Distributing cone
45 Top
60 Drop device, drop pipe
61 Curved section
62 Outlet
64 Lower end
68 Strut
80 Milling device
81 Milling tool
82 Grinding pendulum
84 Pendulum shaft
86 Grinding roller
88 Crosshead
90 Grinding stock feed

92 Chute
94 Grinding stock outlet
100 Classifier
102 Classifying zone
110 Classifier wheel
111 Guide vane assembly
112 Suction device
114 Classifier shaft
116 Lower edge
130 Boundary wall
B1 Milling space
B2 Transport space
B3 Classifying space
A Outlet direction
D Turning direction of distribution plate
D1 Diameter of classifier wheel
D2 Outer diameter of guide vane assembly, outer diameter of classifier
Dv Diameter of distribution plate
H Vertical axis
K1 Circle
K2 Circle
P1 Flow arrow
P2 Flow arrow
R Radial direction
U Orbit
X Axis of rotation, longitudinal axis
γ Angle

What is claimed is:

1. A mill, comprising:

a longitudinal axis X and a classifier, wherein the mill has a mill housing with an interior in which there is situated a milling space B1 in which a milling device having at least one milling tool is arranged, wherein the classifier is arranged in the mill housing, above the milling device in a classifying space B3 and has a classifying zone, and wherein at least one drop device is provided which connects the classifying space B3 to the milling space B1, wherein at least one distribution plate is arranged below the classifier, having at least one drop opening, wherein one of the at least one drop device is arranged on each one of the at least one drop opening, wherein a diameter Dv of the distribution plate is equal to or greater than a diameter D1 of a classifier wheel of the classifier, and wherein the at least one drop device is provided away from the center of the at least one distribution plate.

2. The mill as claimed in claim 1, wherein an encircling boundary wall is arranged between the classifier and the distribution plate.

3. The mill as claimed in claim 1, wherein a plurality of drop openings are provided in the at least one distribution plate, being arranged on a circle K1.

4. The mill as claimed in claim 1, wherein the at least one drop device is arranged in the interior of the mill housing.

5. The mill as claimed in claim 1, wherein the at least one drop device is associated with the at least one milling tool, and the drop device extends in the milling space (B1) as far as the respective milling tool.

6. The mill as claimed in claim 1, wherein at least one drop device is arranged respectively between two milling tools.

7. The mill as claimed in claim 1, wherein at least one outlet of the drop device is directed at a mill bottom and/or a grinding track and/or a grinding roller of the milling tool.

8. The mill as claimed in claim 7, wherein one horizontal component of an outlet direction A of the outlet of the at least one drop device makes an angle γ with a radial direction R of a circle K2 on which the drop devices are arranged, while $70° < \gamma < 110°$.

9. The mill as claimed in claim 1, wherein one horizontal component of an outlet direction A of the outlet of the at least one drop device makes an angle γ with a radial direction R of a circle K2 on which the drop devices are arranged, while $-30° < \gamma < +30°$.

10. The mill as claimed in claim 1, wherein the at least one drop device is tapered at a lower end or has a smaller cross section than the rest of the drop device.

11. The mill as claimed in claim 1, wherein the at least one drop device has a curved section with an outlet at a lower end.

12. The mill as claimed in claim 1, wherein the drop device comprises a drop space, which is separated off inside the mill housing by fixtures, a drop pipe and/or a drop tube.

13. The mill as claimed in claim 1, wherein the milling device and the at least one drop device are able to rotate about the longitudinal axis X.

14. The mill as claimed in claim 1, wherein the distribution plate is arranged on the milling device, and wherein the milling device is a rotatable milling device.

15. The mill as claimed in claim 1, wherein the at least one distribution plate is secured on a drive shaft of the mill and/or on a crosshead secured to the drive shaft.

16. The mill as claimed in claim 1, wherein the at least one scoop is arranged in the mill housing, and each scoop is associated with a drop device.

17. The mill as claimed in claim 1, wherein at least one outlet of the drop device is directed at a scoop.

* * * * *